US006102792A

United States Patent [19]

Nyström

[11] Patent Number: 6,102,792

[45] Date of Patent: Aug. 15, 2000

[54] MIXING BOX FOR MIXING AIR STREAMS FROM TWO TUBULAR CHANNELS

[75] Inventor: Bernt Nyström, Huddinge, Sweden

[73] Assignee: Air Innovation Sweden AB, Sodertalje, Sweden

[21] Appl. No.: 09/091,026

[22] PCT Filed: Nov. 28, 1996

[86] PCT No.: PCT/SE96/01562

§ 371 Date: Jun. 5, 1998

§ 102(e) Date: Jun. 5, 1998

[87] PCT Pub. No.: WO97/21963

PCT Pub. Date: Jun. 19, 1997

[30] Foreign Application Priority Data

Dec. 8, 1995 [SE] Sweden ..... 9504398

[51] Int. Cl.[7] ..... F24F 3/052

[52] U.S. Cl. ..... 454/266; 454/267

[58] Field of Search ..... 454/261, 265, 454/266, 267, 268, 269; 236/49.3

[56] References Cited

U.S. PATENT DOCUMENTS

| | | | |
|---|---|---|---|
| 1,770,593 | 7/1930 | Johnson | 454/269 X |
| 2,793,812 | 5/1957 | McDonald | 236/13 |
| 2,794,598 | 6/1957 | Waterfill | 236/68 R |
| 2,922,580 | 1/1960 | Phillips et al. | 454/265 X |
| 2,981,474 | 4/1961 | Frummond et al. | 454/265 |
| 3,026,041 | 3/1962 | Jentoft | 454/265 X |
| 3,376,916 | 4/1968 | Gressett | 454/265 X |
| 4,019,566 | 4/1977 | Cobb . | |

FOREIGN PATENT DOCUMENTS

| | | |
|---|---|---|
| 0466455 | 1/1992 | European Pat. Off. . |
| 419478 | 8/1981 | Sweden . |
| 89/03006 | 4/1989 | WIPO . |

*Primary Examiner*—Harold Joyce

*Attorney, Agent, or Firm*—Ostrolenk, Faber, Gerb & Soffen, LLP

[57] ABSTRACT

A dual-channel mixing box (1) is arranged in series with other such mixing boxes in order to regulate the temperature of the air in one room each or in several rooms. Each mixing box is provided with supply pipes (3,4) running through it, in which air of different temperatures flows. Each supply pipe is provided with a damper (5), the dampers in a mixing box (1) being adjustable by means of a motor-operated rod (6) so that when one damper is moved in closing direction, the other damper is moved in opening direction, and vice versa. A mixing chamber (11) for the air from both supply pipes is formed between the supply pipes (3,4). The mixing chamber is in controllable communication with one or two outlet chambers (12) communicating through pipes with the room(s) in which the temperature is to be regulated via the mixing box in order to supply a mixture of air with the desired temperature. The controllable connection between the mixing chamber and each outlet chamber comprises a screw mechanism (9) arranged in each supply pipe in order to clamp the supply pipe to form a gap (10) between the chambers.

15 Claims, 3 Drawing Sheets

A – A

C

MIXING BOX FOR MIXING AIR STREAMS FROM TWO TUBULAR CHANNELS

TECHNICAL FIELD

The present invention relates to a mixing box for regulating the temperature of an air stream, said box comprising a chamber having dampers for mixing air of different temperatures. The air is supplied to the mixing chamber from two tubular channels which supply air streams with mutually different temperatures.

BACKGROUND ART

Such dual-channel systems are known for mixing a cold and a warm air stream, enabling quick and reliable temperature control. This is an interesting possibility in order to lower the costs for installation and energy in a ventilated building since it eliminates the need for pipe systems for hot and cold water outside the machine room. Several makes were on the market during the 70s and 80s and many systems were installed.

However recent development has departed from this technology in favour of water-borne heating and cooling, such as fan coil units or cooling ceiling combined with radiators. One reason was that the known mixing boxes entailed certain drawbacks, the dampers in the mixing boxes having a tendency to clog after some time in use, for instance, and that overflow often resulted between the supply channels so that the fundamental principle of the system entailing the supply of air at different temperatures was disrupted. Another problem with the known installations was that their mixing boxes require a considerable amount of space and must be installed in each room to be ventilated. The boxes also require pipes to be laid that take up relatively much space.

DESCRIPTION OF THE INVENTION

The drawbacks mentioned above have been eliminated with a mixing box designed in accordance with the present invention. Characteristic of the mixing box according to the invention is that the tubular channels are arranged to pass through the mixing chamber and each channel is provided with a damper. These dampers can be operated by a control means so that when the damper in one tubular channel is moved in closing direction the damper in the other tubular channel is moved in opening direction. Furthermore the mixing chamber is designed to supply one or more feed-out channels with the temperature-regulated air mixture, this or these feed-out channels leading to the room(s) to be heated/cooled.

By means of advantageous further developments of the mixing box in accordance with the limitations defined in the dependent claims, a dual-channel system has been developed that is simple to install both in existing buildings and in new buildings, without major alterations having to be made in each of the rooms where the temperature is to be regulated by means of the ventilation air supplied.

According to one aspect of the invention all the mixing boxes form a part of the main pipe for the air to be supplied, this main pipe with the mixing boxes being placed in the ceiling of a corridor, for instance, running beside the rooms to be heated/cooled, each of which need only be provided with a ventilator of conventional type. Since the dimensions of the mixing boxes do not deviate to any great extent from what is required for the two air-supply channels of the main pipe, the ceiling of the corridor need not be noticeably lowered.

The mixing box and the installation in accordance with the present invention created thereby, offer the following advantages besides those mentioned above:

- require little space
- have no intersecting pipe ducts
- the mixing box constitutes a part of the pipe system
- require no pipes leading to and from
- outlets can be applied at any point on the mixing box
- the amount of air can be accurately regulated
- different amounts of air can be supplied to different rooms
- the temperature can be accurately regulated, and
- an unlimited number of mixing boxes can be connected in series

DESCRIPTION OF THE PREFERRED EMBODIMENT

The advantages mentioned above and others will become evident from the following more detailed description of the mixing box according to the invention. The invention is illustrated by describing a preferred, but not limiting, embodiment of the mixing box as shown in the accompanying drawings in which FIG. 1 shows a basic diagram of a known installation for temperature-regulated ventilation of individual rooms in a building.

Figure 2:
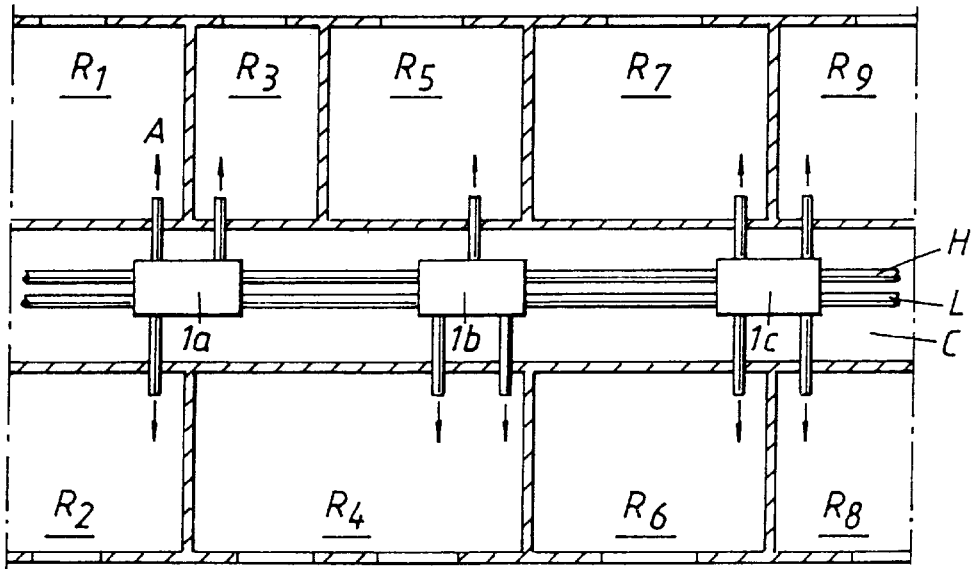
Figure 3:
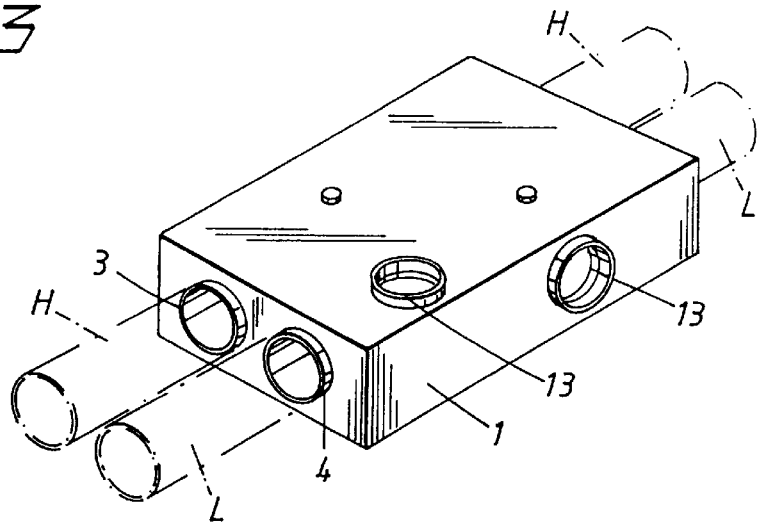
Figure 5:
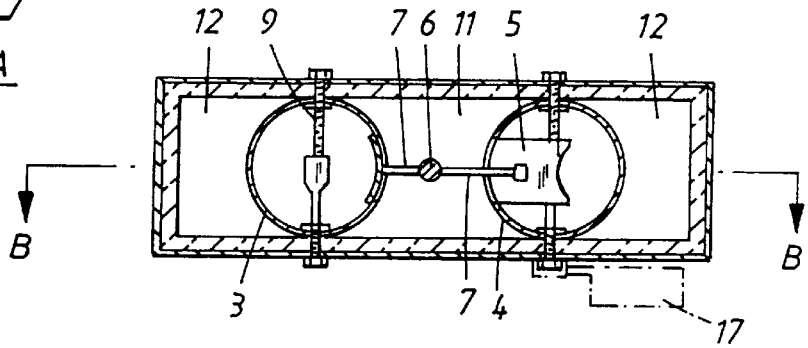
Figure 6:
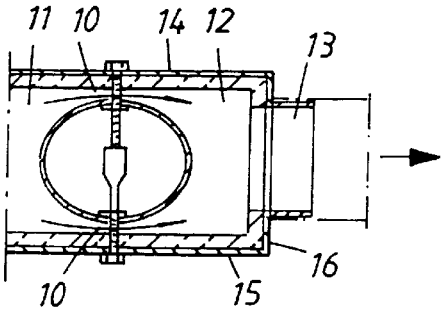
Figure 4:
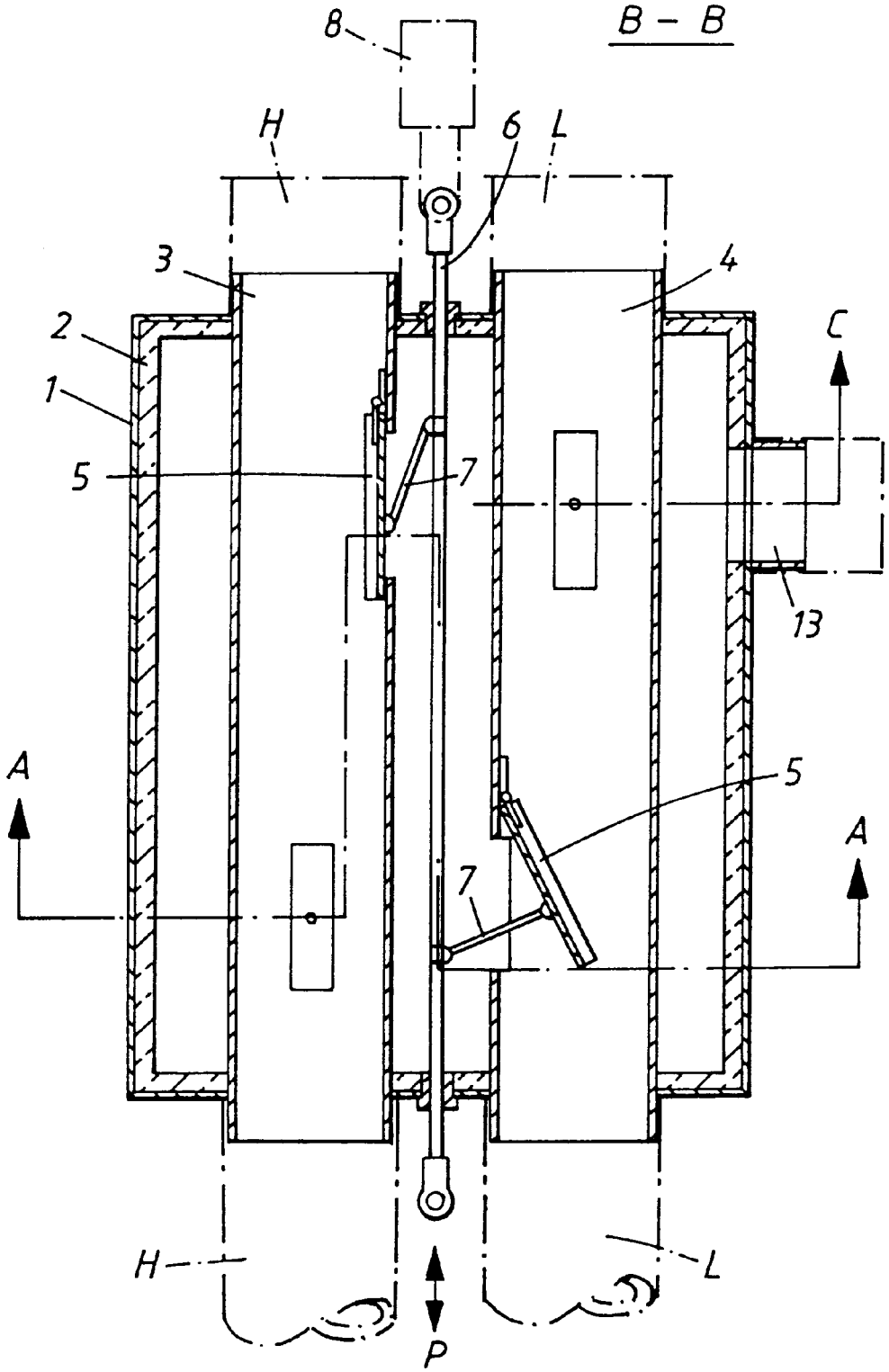

FIG. 2 shows a basic diagram for a corresponding installation designed with mixing boxes according to the present invention, FIG. 3 shows in perspective a preferred embodiment of the mixing box according to the invention, and FIGS. 4–6 show different sections through the mixing box shown in FIG. 3.

Figure 1:
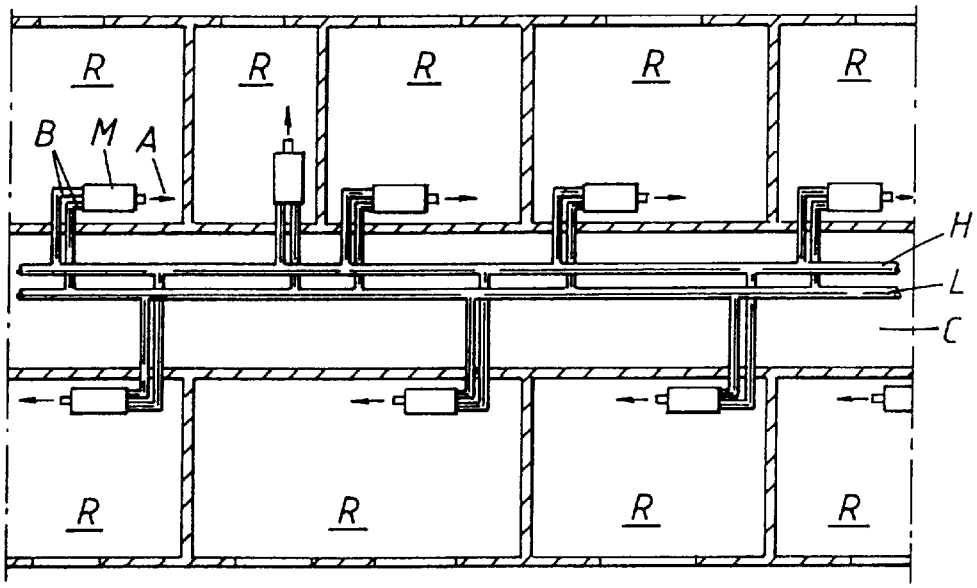

FIG. 1 reveals a known installation for ventilation and heating of individual rooms R in a building by mixing air of different temperatures. The example shown is an office or hospital building with a corridor C having a main pipe arranged in the ceiling, comprising two tubular channels H and L. The parallel channels H, L supply air in the same direction, channel H supplying air with higher temperature than the air in channel L, for instance.

For each room R the tubular channels H, L are provided with a branch B leading to a mixing box M located in the room R. The branch B thus terminates in the known type of mixing box M, in which air from the two tubular channels H, L is mixed in order to obtain the desired temperature in the air A supplied to the room R. The room can be ventilated with the supply air A at the same time as the temperature is regulated to warm the room in winter and cool it in summer.

As can be seen in FIG. 1, the known installation requires a number of mixing boxes and the pipe-laying is therefore relatively complicated and space-consuming. There is also a tendency for overflow between the tubular channels H and L due to the design of the known mixing boxes M.

FIG. 2 shows an equivalent building plan equipped with an installation in accordance with the present invention. Just as in the installation described above, the main pipe of the present installation comprises two tubular channels H, L for the supply of air of different temperatures. In the installation according to the invention the tubular channels H, L pass through mixing boxes 1 which are thus arranged in series with each other. Each such mixing box 1 can supply one or more rooms R with air A. As will be described in detail below, the mixing box 1 according to the invention can supply different quantities of air to different rooms R.

FIG. 2 shows variants of the mixing box 1 as examples of different ways of supplying the rooms R with air A. The mixing box 1*a* thus supplies three rooms $R_1$–$R_3$ with air A. The rooms $R_1$ and $R_3$ are supplied with the same amount of air whereas the room $R_2$ is supplied with a different amount of air. The mixing box 1*b* supplies rooms $R_4$ and $R_5$. Room $R_4$ is supplied via two branch pipes due to its size. The amounts of air supplied to rooms $R_4$ and $R_5$ may be different. Finally, FIG. 2 shows a mixing box 1*c* that supplies rooms $R_6$–$R_9$. The amount of air supplied to room $R_6$ may be set at a different value from that supplied to the other rooms $R_7$–$R_9$.

The settings in mixing boxes 1*a*, 1*b*, 1*c* may be different for temperature and air-quantity.

A description of a preferred embodiment of the mixing box 1 according to the invention follows, referring to FIGS. 3–6. FIG. 3 shows the mixing box 1 in perspective. It is dear that it is connected to the tubular channels H, L, indicated by broken lines in the figure. These channels H, L pass through the mixing box since they are connected to supply pipes 3, 4, respectively. Two feed-out channels 13 lead from the mixing box 1 and are intended for connection to air-supply devices in one or more of the rooms (R in FIG. 2) to be ventilated and temperature-regulated. FIG. 4 shows a longitudinal section of the mixing box 1. The mixing box 1 is made of sheet metal or some other suitable material, preferably provided with thermal insulation 2. The two supply pipes 3, 4 connected to the tubular channels H, L are provided with openings cooperating with dampers 5. The damper openings communicate with a part-chamber 11 (FIGS. 5 and 6) for mixing air of different temperatures supplied from each of the supply pipes 3, 4. The part-chamber 11, also termed the mixing chamber, is thus situated between the two supply pipes 3,4.

The dampers 5 can be regulated by means of an operating rod 6 running parallel to the longitudinal direction of the supply pipes. FIG. 4 shows the dampers 5 in one of two end positions in which one damper (for supply pipe 3 with hotter air) is completely closed, whereas the other damper (for supply pipe 4 for cooler air) is completely open. By means of the operating rod 6 and damper mechanism 7 the dampers 5 can be caused to assume any desired intermediate position through to the opposite end position in which the supply from pipe 3 is completely open and the supply from pipe 4 is completely closed.

The operating rod 6 is thus displaceable with a longitudinal movement as indicated by the double arrow P. This is achieved with the aid of a damper motor 8, the control signals for the motor being obtained from a thermostat (not shown) and/or other control device located in each room R. The motor 8 may also be governed by other control means that may be arranged in a central station or a machine room.

Air from the supply pipes 3, 4 is thus mixed in the mixing chamber 11 so that it has a desired/set temperature. For feed-out via the channels 13, each supply pipe 3, 4 is influenced by a flow-regulating screw mechanism 9 as illustrated in FIGS. 5 and 6. The screw mechanism preferably comprises two counter-threaded screws journalled on the outside of opposing surfaces on the mixing box 1, namely on the upper side 14 and lower side 15 of the casing.

The screw mechanism 9 can be actuated by an adjustment motor 17. This motor 17, which may be controlled by the above-mentioned thermostats and/or other control means, compresses the supply pipes 3, 4 to form a gap 10 between the pipe 3 or 4 and the adjacent inner side of the upper or lower sides 14 and 15 of the casing. FIG. 5 shows this gap 10 closed, whereas FIG. 6 shows the gap 10 in partially open state so that mixed air can flow from the mixing chamber 11 to the feed-out chambers 12 communicating with said feed-out channels 13.

The feed-out channels 13 can be connected to the feed-out chambers 12 on the upper, lower and/or end sides 14, 15, 16, respectively, of the mixing box 1. See also FIGS. 2 and 3.

The function of the dual-channel mixing box in an installation according to the invention is thus to maintain the desired temperature in each individual room R with a desired quantity of air per time unit. This is achieved by operating the displaceable rod 6 and associated damper mechanism 7 to alternately open or close the damper 5. The damper motor 8 arranged outside the mixing box 1 is governed by a thermostat located somewhere in the stream of mixed air with the task of maintaining a constant temperature, for instance, in a room R. A variable air flow in sequence with temperature control of the dampers 5 can be obtained by means of the motorised screw mechanism 9.

The size of the mixing boxes 1 is determined by the dimension D of the main channels H, L and supply pipes 3, 4, the dimension being chosen taking into consideration the required air stream and selected velocity of the air in the channels/pipes. A typical size is: $20 \leqq D \leqq 40$ cm.

An optional number of mixing boxes are placed in series along the two channels H, L to ventilate rooms R in the vicinity. The tubular channels H, L are supplied with a pressure control means at their connection to the riser channels (not shown) from the machine room, so that even at low pressure drop above them the dampers 5 of the mixing boxes 1 will provide reliable temperature control. Typical pressure drop: $50 \leqq \Delta p \leqq 100$ Pa, including connection channel 13 and air supply device (not shown) in each room R to be ventilated heated cooled.

Although a preferred embodiment has been described above with reference to the drawings, the invention shall not be deemed to be limited thereby. Innumerable variations and modifications are feasible without departing from the inventive concept. The damper arrangement may be designed differently, for instance, the dampers 5 being arranged on the outside of the supply pipes 3, 4, the rod 6 being replaced by a screw or other turning mechanism, and so on. The gap openings 10 may also be replaced by other adjustable openings and/or control means. The circular cross section shown for the supply pipes 3, 4 may be varied and the height h of the mixing box 1 may be less than the diameter D of the supply pipes. The invention is thus not intended to be limited to the examples offered above, but only by the definition in the appended claims.

I claim:

1. A mixing box for regulating the temperature of an air stream, said box comprising a chamber having dampers for mixing air of different temperatures, said air being supplied from two tubular channels, each supplying an air stream with mutually different temperatures, wherein the tubular channels pass through the mixing chamber, each channel being provided with a damper, and the dampers being operable by means of a control device so that when one damper is moved in closing direction the other damper is moved in opening direction, and vice versa, and in that the mixing chamber is provided with one or more feed-out channels in order to supply the temperature-regulated air mixture to one or more rooms to be heated/cooled.

2. A mixing box as claimed in claim 1, wherein the control device comprises a motor-operated rod running along the tubular channels, which is arranged via damper mechanisms to activate the dampers arranged on the channels, the motor being governed via a thermostat arranged in the room and/or at a central point.

3. A mixing box as claimed in claim 1, futher comprising by connection openings arranged in opposite end walls of each of the tubular channels, said channels being connected to supply pipes arranged in the mixing chamber and running through said chamber, the envelope surface of said pipes being provided with an opening for cooperation with a damper.

4. A mixing box as claimed in claim 3, wherrein the supply pipes have circular cross section and each damper has an arc shape corresponding thereto.

5. A mixing box as claimed in claim 3, wherein the openings of the tubular channels/supply pipes provided with dampers are displaced in relation to each other in the longitudinal direction of the channels/pipes so that air from each channel/pipe to be mixed in the chamber is arranged to flow into this at substantially diametrically opposite ends of the mixing chamber.

6. A mixing box as claimed in claim 3, wherein the external dimensions of the channels/pipes are substantially equivalent to the inner height of the mixing chamber so that the mixing box is divided into an inner part-chamber for air mixing situated between the tubular channels/supply pipes, and outer part-chambers situated between respective channel/pipe and the longitudinal side of the mixing box.

7. A mixing box as claimed in claim 6, wherein the feed-out channels lead from one or both of the outer part-chambers.

8. A mixing box as claimed in claim 6, futher comprising by adjustment means for controlled supply of air mixture from the inner part-chamber to one and/or the other of the outer part-chambers.

9. A mixing box as claimed in claim 8, wherein the adjustment means comprises a screw mechanism for each channel/pipe, actuatable from outside the mixing box and arranged to run through the channel/pipe to raise it from contact with the inner walls of the mixing box.

10. A mixing box as claimed in claim 9, wherein the screw mechanism comprises two counter-threaded and cooperating pins pivotably journalled in the top and bottom walls of the mixing box for adjustment of the air-mixture supply between the inner and outer part-chambers by clamping together the relevant channel/pipe.

11. A mixing box as claimed claim 8, wherein the adjustment means is spaced from the damper in the relevant channel/pipe.

12. A mixing box as claimed in claim 8, wherein each adjustment means can be actuated by means of an auxiliary motor activated by a circuit breaker and/or thermostat.

13. Dual-channel installation for controlling the temperature of an air stream intended for supply to various rooms by means of one or more mixing boxes as claimed in claim 1, wherein the mixing boxes are connected in series to the tubular channels of the dual-channel installation.

14. Installation as claimed in claim 13, wherein at their connection to the risers from a central station, the tubular channels are provided with a pressure control device so that the dampers in each mixing box will provide reliable temperature control even if the pressure drop above them is low.

15. Installation as claimed in claim 8, futher comprising a motor controlling the dampers and/or an auxiliary motor for adjusting the adjustment means can be actuated depending on local thermostats in each room and/or by control elements arranged in a machine room.

* * * * *